US011261704B2

(12) United States Patent
Anderson et al.

(10) Patent No.: US 11,261,704 B2
(45) Date of Patent: Mar. 1, 2022

(54) METHOD AND APPARATUS FOR WASHING AN ANNULUS

(71) Applicant: Weatherford U.K. Limited, Leicestershire (GB)

(72) Inventors: Neil Anderson, Aberdeen (GB); Michael Ronson, Aberdeen (GB)

(73) Assignee: Weatherford U.K. Limited, Leicestershire (GB)

( * ) Notice: Subject to any disclaimer, the term of this patent is extended or adjusted under 35 U.S.C. 154(b) by 0 days.

(21) Appl. No.: 16/764,876

(22) PCT Filed: Nov. 19, 2018

(86) PCT No.: PCT/GB2018/053345
§ 371 (c)(1),
(2) Date: May 17, 2020

(87) PCT Pub. No.: WO2019/097259
PCT Pub. Date: May 23, 2019

(65) Prior Publication Data

US 2020/0340332 A1 Oct. 29, 2020

(30) Foreign Application Priority Data

Nov. 20, 2017 (GB) ..... 1719216

(51) Int. Cl.
*E21B 33/12* (2006.01)
*E21B 33/13* (2006.01)
(Continued)

(52) U.S. Cl.
CPC ..... *E21B 37/00* (2013.01); *E21B 17/22* (2013.01); *E21B 23/004* (2013.01); *E21B 33/12* (2013.01);
(Continued)

(58) Field of Classification Search
CPC ..... E21B 33/12; E21B 33/14; E21B 37/00
(Continued)

(56) References Cited

U.S. PATENT DOCUMENTS 3,367,420 A * 2/1968 Jennings ..... E21B 33/134 166/276
9,010,425 B2 * 4/2015 Larsen ..... E21B 33/13 166/285
(Continued)

FOREIGN PATENT DOCUMENTS

WO 2012/105852 A1 8/2012
WO 2014/109643 A1 7/2014
(Continued)

OTHER PUBLICATIONS

Combined Search and Examination Report in counterpart UK Appl. GB1719216.2, dated Mar. 21, 2018, 9-pgs.
(Continued)

*Primary Examiner* — Zakiya W Bates
*Assistant Examiner* — Ashish K Varma
(74) *Attorney, Agent, or Firm* — Blank Rome LLP

(57) ABSTRACT

Some examples of the present disclosure relate to a method for washing an annulus that at least partially surrounds a casing in a well. The method comprises locating a tool inside a wellbore casing, and flowing a washing fluid from an injection aperture on the tool and into the annulus via a first casing aperture in the casing. An inflow region of the casing is created having a reduced pressure relative to the annulus, and the method involves flowing the washing fluid from the annulus and into the inflow region of the casing through a second casing aperture in the casing.

19 Claims, 7 Drawing Sheets

(51) Int. Cl.

| | |
|---|---|
| ***E21B 37/00*** | (2006.01) |
| ***E21B 34/14*** | (2006.01) |
| ***E21B 17/22*** | (2006.01) |
| ***E21B 23/00*** | (2006.01) |
| ***E21B 33/126*** | (2006.01) |
| ***E21B 33/14*** | (2006.01) |
| ***E21B 43/116*** | (2006.01) |

(52) U.S. Cl.
CPC ..... *E21B 33/126* (2013.01); *E21B 33/13* (2013.01); *E21B 33/14* (2013.01); *E21B 34/142* (2020.05); *E21B 43/116* (2013.01); *E21B 2200/06* (2020.05)

(58) Field of Classification Search
USPC ..... 166/285
See application file for complete search history.

(56) References Cited

U.S. PATENT DOCUMENTS

| | | | | |
|---|---|---|---|---|
| 9,334,712 | B2 * | 5/2016 | Bakken | E21B 33/134 |
| 2014/0138078 | A1 * | 5/2014 | Lerbrekk | E21B 43/116 166/55 |

FOREIGN PATENT DOCUMENTS

| | | | |
|---|---|---|---|
| WO | 2015/026239 | A2 | 2/2015 |
| WO | 2015/034369 | A1 | 3/2015 |
| WO | 2015/105427 | A2 | 7/2015 |
| WO | 2018/017104 | A1 | 1/2018 |

OTHER PUBLICATIONS

Examination Report in counterpart UK Appl. GB1719216.2, dated Mar. 17, 2020, 3-pgs.
International Search Report and Written Opinion in counterpart PCT Appl. PCT/GB2018/053345, dated Mar. 18, 2019, 11-pgs.

* cited by examiner

METHOD AND APPARATUS FOR WASHING AN ANNULUS

FIELD

The present disclosure relates to a method and apparatus for washing an annulus. Some examples may involve washing an annulus as part of well abandonment.

BACKGROUND

In an existing well there are various casing strings normally run concentrically within one another or suspended inside the next largest casing above as a liner. Each casing or liner generally extends deeper in measured depth (MD) than the previous larger size casing or liner. As each section of the well is drilled there comes a point where the overburden pressure, or low formation strength, requires that the section be isolated and sealed from the main wellbore. To achieve this, casing is run into the well starting with the casing "shoe" and ending with the casing hanger. Once at the planned depth the casing is cemented in place around the casing shoe. The cement supports and isolates the formation and casing from the main wellbore.

Once each casing has been cemented, drilling continues with progressively smaller drill bits through the cemented casing shoe until pressure and formation integrity require the next casing string be run and cemented. This process continues until passing through the producing or receiving formation. Once drilling is complete and all the casings and liners are cemented to the full drilled depth, the well is fully isolated from the surrounding formation and pressure regimes. To complete the well, production tubing can be run from surface to the zone of interest and the tubing and production casing perforated to allow the flow of fluid out of the well in the case of a producer or into the formation in the case of an injection well.

The annuli between the casings is normally a combination of hard cement around the shoe, contaminated softer cement on top, with the original drilling fluid on top of that. In older wells it is common for the weighting solids in the mud, such as barite, to settle out, or "sag", creating a high density unconsolidated material at the contaminated cement interface and a lighter fluid further up the annulus to surface.

For permanent abandonment of a well there is a legal requirement to ensure fluids and gases from one formation cannot migrate into another in such a manner that contamination of groundwater or leakage to the earth's surface or the seabed around the well can happen. To be sure that this is not the case, it is often necessary to remove one or more of the casings in the well to access the formations, which may be over or under-pressured and susceptible to migration of fluids or gases. Where there is good cement, casing removal may not be necessary, but well records may be insufficient to show where the cement is or the cement may be inconsistent in its quality or placement. Under these circumstances the casing must normally be removed in order to place a remedial cement barrier.

The casing can be removed by mechanical cutting and pulling with a spear, provided the casing is free. Alternatively a stuck casing can be "pilot milled" from the top down after pulling out the free section of casing. The casing can also be "section milled" by running a hydro/mechanical tool to the target depth, opening the arms on the tool then applying weight and milling away a window or section in which to place the remedial cement barrier. This can be in "open hole" with the formation or inside the next largest casing.

Cutting and pulling casing is time consuming and becomes more difficult as the casing becomes more stuck in the unconsolidated, sagged material from the annular mud and often finishes with milling the last hundreds of meters. Any form of milling is also time consuming and produces large volumes of swarf, which requires appropriate disposal.

An alternative method is to use a technique currently known as "perf and wash" or "perf, wash and cement". This technique involves perforating a casing, and flushing the annulus to remove debris contained therein.

This technique involves running a tool into a casing to perform the perf and wash operation into the well. This can, of itself, provide problems if, for example, the tool encounters a surge of pressure within the casing. A surge in pressure may urge the tool, and any tubing or equipment attached thereto, back through the casing towards the surface of the well. In turn this may, for example, cause tubing to spool out of the casing at the surface, which may cause a danger to personnel working at surface.

SUMMARY

An aspect of the present disclosure relates to a method for washing an annulus that at least partially surrounds a casing in a well, comprising: locating a tool inside a wellbore casing; flowing a washing fluid from an injection aperture on the tool into the annulus through a first casing aperture in the casing; creating an inflow region within the casing having reduced pressure relative to the annulus; flowing the washing fluid from the annulus and into the inflow region of the casing through a second casing aperture in the casing.

In use, the method may be used to wash the annulus in a well to remove debris therefrom, or to remove an existing cement sheath in the annulus, by injecting washing fluid from the injection aperture of the tool and through the first casing aperture and into the annulus. The annulus may be between the casing and a formation, or between two sections of casing. The washing fluid may re-enter the casing from the annulus by passing through the second casing aperture. The reduced pressure in the inflow region may assist flow from the annulus and into the casing. That is, the reduced pressure may provide a "suction" effect within the casing. The fluid which has re-entered the casing may be flowed to surface.

Once the annulus has been washed, further operations may be performed. Further operations may include, for example, cementing operations, monitoring operations, treatment operations, steps to abandon the well (e.g. to plug the well) or the like. Having already washed the annulus, the efficacy of further operations may be improved. For example, cementing operations may be able to be performed more easily due to a reduction in obstructive debris or oil residue in the annulus, which may allow the cement to have a better bond with the casing.

Washing the annulus may provide a localized region of increased flow velocity in the annulus, which may be achieved by the removal of blockages such as debris from the annulus. Increased flow velocity may assist to ensure that further operations are performed more fully and/or more quickly.

The injection aperture may inject the washing fluid into a region between the tool and the casing. The inflow region may be remote from the delivery of the washing fluid from the injection region. The inflow region may be axially spaced apart from the injection region.

The method may comprise reducing the pressure in the inflow region by generating a localized fluid turbulence within the casing, thereby creating the inflow region within the casing having reduced pressure relative to the annulus. The method may comprise reducing the pressure in the inflow region by providing a localized increase in a velocity of a fluid within the casing. The fluid in this case may be defined as an operating fluid. The velocity of the operating fluid may be increased by, for example, swirling said fluid within the casing. Swirling the operating fluid may create a vortex of operating fluid in the inflow region.

In some examples the method may comprise providing a localized increase in a velocity of the operating fluid delivered into the casing from the tool. In such an example, the operating fluid may be delivered into a region which is remote from the injection aperture of the tool.

A pressure reduction apparatus may be provided on the tool to facilitate or provide a pressure reduction in the inflow region. The pressure reduction apparatus may comprise at least one fluid aperture or nozzle through which the operating fluid can be flowed (e.g. injected) into the casing. The pressure reduction apparatus may be configured to establish a desired flow regime within the casing to encourage or provide a reduced pressure in the inflow region, for example a turbulent flow regime. For example, the pressure reduction apparatus may direct an operating fluid being flowed therefrom in a specific direction, e.g. with a component of velocity directed circumferentially and/or helically and/or vertically relative to the tool.

The operating fluid may be the same fluid as the washing fluid. A portion of the washing fluid may be separated from a main flow of washing fluid and used as the operating fluid. Alternatively, the operating fluid may be different to the washing fluid (e.g. an entirely different fluid flow and/or entirely different fluid). The operating and/or washing fluid may be selected to have specific properties, e.g. a preferred density, to enable either or both of the operating and washing fluid to wash the annulus or create an increase in fluid velocity most effectively.

The method may comprise flowing the operating fluid through the at least one fluid aperture or nozzle on the pressure reduction apparatus, the at least one fluid aperture or nozzle being configured to provide a direction to the flow therefrom. For example, the at least one fluid aperture or nozzle may be shaped to provide a flow direction to the operating fluid. The at least one fluid aperture or nozzle may be configured to create a jet of operating fluid. The method may comprise flowing the operating fluid through multiple fluid apertures or nozzles located on the pressure reduction apparatus.

The pressure reduction apparatus may comprise one or more vanes. The vane or vanes may assist to direct the flow of operating fluid from the at least one fluid aperture or nozzle, for example to generate a swirl of operating fluid. At least one fluid aperture or nozzle of the pressure reduction apparatus may be posited intermediate two vanes. At least one fluid aperture or nozzle of the pressure reduction apparatus may be located on a vane. The vane may have a side portion and a tip portion, and the fluid aperture or nozzle may be located on the side portion or the tip portion of the vane.

The method may comprise flowing the operating fluid through a plurality of fluid apertures or nozzles located on the side and/or tip portions of the vane or vanes The method may comprise fluidly operating the pressure reduction apparatus (i.e. using a fluid to operate the pressure reduction apparatus). The degree of operation of the pressure reduction apparatus may be controlled by the operating fluid. For example, a reduced flow of operating fluid may correspondingly diminish the operation of the pressure reduction apparatus, for example by reducing flow through the at least one fluid aperture or nozzle of the pressure reduction apparatus.

The method may comprise varying the configuration of the at least one fluid aperture or nozzle. For example, the method may comprise configuring the at least one fluid aperture or nozzle to an open, closed and/or intermediate configuration.

The pressure reduction apparatus may comprise a restriction component which may function to restrict flow of operating fluid through the at least one fluid aperture or nozzle of the pressure reduction apparatus, for example by occluding or partially occluding the at least one fluid aperture or nozzle. The restriction component may be able to be moved relative to the pressure reduction apparatus in order to restrict the flow of operating fluid through the at least one fluid aperture or nozzle. The restriction component may be, for example, a sleeve. The restriction component may be operated by, for example, a dropped ball, a dart, hydraulic action, via a wire extending from surface, or the like.

An indexing tool may be used to control operation of the restriction component. For example, the indexing tool may be used to control the movement of the restriction component to incrementally close or open the at least one fluid aperture or nozzle of the pressure reduction apparatus by occluding the at least one fluid aperture or nozzle with the restriction component. The indexing tool may comprise a ratchet system, for example. The indexing tool may be operated by dropping an object into the well, which may contact the indexing tool to move the restriction component. Additionally or alternatively, the indexing tool may be controlled by hydraulic action, wireline, or the like.

The method may comprise perforating the casing to provide one or both of the first and second casing apertures. The method may comprise perforating the casing to provide a plurality of first casing apertures. The method may comprise perforating the casing to provide a plurality of second casing apertures. The method may comprise providing a perforation system to provide one or both of the first and second casing apertures. The perforation system may be integrated into the tool. The perforation system may be, for example, an array of TCP guns. The perforation system may be run into the well ahead of the tool, for example on a leading end of the tool. The perforation system may be released from the tool after use. The perforation system may be retrieved to the surface of the well, or may be dropped down the well.

The method may comprise providing a perforated section of casing, having existing perforations, in the well. The existing perforations may provide one or both of the first and second casing apertures. As such, the method may not require perforation of the casing with the perforation system. The method may comprise opening existing perforations on the casing, for example an existing first and second casing aperture.

The method may comprise providing a sealing arrangement between the tool and the casing to restrict flow of the washing fluid in the casing. The sealing arrangement may define an injection region within the casing. The sealing arrangement may function to isolate the injection region from the inflow region. The sealing arrangement provided between the tool and the casing may be or comprise, for example, a cup seal arrangement. The sealing arrangement may ensure that the flow of washing fluid from the injection region to the pressure reduction apparatus is via the annulus, i.e. the sealing arrangement may be, at least partially, provided intermediate the injection region on the tool and the inflow region such that the washing fluid may flow from the injection region to the inflow region via the annulus.

The sealing arrangement may be operated by flow through the injection aperture. For example, flow through the injection aperture may activate the sealing arrangement.

The method may comprise providing a plurality of seals on the tool, e.g. a plurality of cup seals. Two seals may be provided on the tool, e.g. two cup seals. Each of the plurality of seals may be axially separated relative to the tool. Each of the two seals may be provided on opposing axial sides of the injection aperture. Where the method comprises providing a plurality of cup seals on the tool, each of the plurality of cup seals may be oppositely oriented on the tool. The plurality of seals may assist in flowing the washing fluid from the tool into the annulus, while preventing the washing fluid from dispersing in a region between the tool and the casing without, or with minimized, flow into the annulus.

The method may comprise using the tool to inject a washing fluid into the annulus, which may initially collect in the injection region between the tool and the casing. The volume of fluid able to collect in the injection region may be limited by the presence of a seal on either side of the injection aperture, e.g. uphole and downhole of the injection aperture. As such, the sealing arrangement may assist to improve the efficiency of the flow of fluid from the injection region to the annulus.

The plurality of seals may be used to assist in establishing the positioning of the tool in the well. For example, the seals may permit pressure testing in the injection region to establish positioning of the tool relative to the first and second casing apertures. Where the tool is positioned adjacent the first and/or second casing apertures, washing fluid injected from the tool may flow into the annulus. However, where the tool is not adjacent the first and/or second casing apertures, the washing fluid may collect between the tool and the casing, causing an increase in pressure of the washing fluid in the injection region between the sealing arrangement. The method may comprise detecting an increase and/or decrease in pressure of the washing fluid. The tool may be equipped with a pressure sensor to assist herewith.

The method may comprise bypassing a resident fluid in the casing around the tool, for example when positioning the tool in the casing. Bypassing a resident fluid around the tool may allow easier movement and placement of the tool inside the casing.

The method may comprise flowing a resident fluid through a bypass arrangement located in the tool. For example, a bypass arrangement may extend from a downhole region of the tool to an uphole region of the tool. The method may comprise providing one or more downhole bypass fluid ports and one or more uphole bypass fluid ports on the tool to allow fluid to enter and exit the bypass arrangement. Downhole bypass fluid ports may be provided on the tool further downhole of the injection aperture, and sealing arrangement if present, while uphole bypass fluid ports may be provided on the tool further uphole of the injection aperture, and sealing arrangement if present. As such, the bypass arrangement may facilitate the flow of fluid between regions downhole and uphole of the tool, thereby bypassing components which restrict, or which may be intended to restrict, the flow of fluid in the casing such as a sealing arrangement or a plug. As such, the bypass arrangement may facilitate easier placement of the tool in the casing, by mitigating against the occurrence of a high differential pressure occurring across uphole and downhole regions of the tool.

The method may comprise flowing more than one fluid, e.g. more than one washing fluid, through the tool. The method may comprise flowing a first fluid through the tool. The first fluid may be, for example, water. A second fluid may be flowed through the tool. The second fluid may be a spacer fluid. The spacer fluid may be, for example water, or a water based fluid, combined with additional chemicals, for example surfactants. A third fluid may be flowed through the tool. The third fluid may be, for example, cement. When flowing more than one fluid through the tool, each fluid may be separated by a separator object, such as a dart. Said separator object may restrict the mixing of each different fluid when in the tool string.

The method may comprise dropping or delivering a flow restrictor, such as a dart, into the tool. Once dropped into the tool, the flow restrictor may seat in a restrictor seat. The flow restrictor may block, or restrict, fluid flow through the tool downhole of the flow restrictor. As such the flow restrictor may block fluid flow through a central bore of the tool. When the flow restrictor seats in the dart seat, the pressure in the tool may increase. The method may comprise detecting an increase in pressure in the tool as a result of the flow restrictor seating in the restrictor seat. Such an increase in pressure may be detectable at surface. In the case where more than one fluid is flowed through the tool, the flow restrictor may assist the user to know when a subsequent fluid (e.g. a first fluid or a second fluid or a third fluid) has reached the tool, by providing a surge in pressure in the tool. The flow restrictor may be able to be removed from the tool by increasing the pressure in the tool. The increase in pressure may force the dart, or dropped object, to displace from the restrictor seat, becoming dislodged from the tool and passing therethrough.

The method may comprise flowing the washing fluid from the injection aperture and into the annulus at the same time as the tool is moved relative to the casing.

The method may comprise moving the tool through the casing from an uphole location to a downhole location (i.e. top-down), or vice versa (i.e. bottom-up), while at the same time flowing the washing fluid from the injection aperture and into the annulus. As such, the washing fluid may be flowed through or filled into the entire annulus by movement of the tool through the casing. As the tool is moved through the casing, the apertures through which the washing fluid flows between casing and annulus may change. The casing may comprise a plurality of casing apertures. As the tool is moved through the casing, at least one of the plurality of casing apertures may function as a first casing aperture (i.e. to permit washing fluid to flow from the injection aperture and into the casing), and at least one other of the plurality of casing apertures may function as a second casing aperture (i.e. to permit washing fluid to flow from the annulus and towards the inflow region). Depending on the flow of washing fluid, an aperture that has functioned as a first aperture may also function as a second aperture, and vice versa.

The washing fluid may be flowed into the annulus, moving the tool in a bottom-up configuration. In this configuration, a first casing aperture previously used to flow washing fluid from the injection region to the annulus may subsequently be used as second casing aperture to flow washing fluid from the annulus to the inflow region.

The method may comprise flowing the washing fluid into the annulus at a rate proportionate to the velocity of movement of the tool through the casing. The method may comprise moving the tool through the casing in an incremental step-wise motion while flowing the washing fluid into the annulus. For example, the tool may be held stationary while washing fluid is flowed into the annulus for a predetermined period of time (e.g. 5 minutes), before being moved through the casing to a different location where the tool is again held stationary while washing fluid is flowed into the annulus. The alternation of flowing washing fluid into the annulus and moving the tool through the casing may be repeated as many times as is deemed necessary to wash the annulus. Such movement of the tool through the casing may ensure that an even volume of the washing fluid is flowed into or through the casing.

The method may comprise removing the tool from the casing. Removal of the tool from the casing may comprise rotation of a work string to which the tool is connected, while the tool remains stationary. As such, the tool may be connected to the string via a swivel arrangement. Such rotation of the string may assist to stir up solids in the casing, and thereby assist in clearing the solids from the well, as the string is rotated.

The method may comprise operating a single use component to assist in the removal of the tool from the casing. For example, the method may comprise pressurization of the tool to rupture a burst disk, or dislodge an object e.g. a dart, on a downhole section of the tool and permit fluid flow from the tool into the casing. Operation of the single use component may permit the tool to be more easily removed from the well, for example by allowing fluid (e.g. cement) in the tool or associated string to flow out of the tool and remain in the well, as the tool is lifted. Where the single use component comprises a dislodged object, the tool may be reused, and the dislodged object replaced by dropping another similar object into the tool. The single use component may be the flow restrictor.

The method may comprise the setting of a plug in the well, for example extending the entire diameter of the well, both inside and outside of the casing. The tool may comprise a plug, which may be detached from the tool and set in the casing downhole of the tool. The plug may be attached to the tool via a release mechanism, such as a pressure-release mechanism. The method may comprise increasing the pressure of the fluid within the tool to release the plug. The plug may facilitate further operations using the tool, for example cementing operations, e.g. by supporting a plug of cement from below. The plug may be set downhole of the first and second casing apertures.

The plug may be, for example, a cement plug. The plug may be made of a synthetic material, for example a plastics material, rubber, or the like.

The method may comprise using the tool to perform cementing operations. The cementing operations may comprise flowing cement into the annulus between the casing and the formation, or between two casings. The cementing operations may comprise flowing cement into the casing. The cementing operations may comprise flowing cement from the tool and into the annulus via the injection region. The cementing operations may comprise flowing the cement from the annulus and into the inflow region uphole of the sealing arrangement.

The method may comprise providing the tool with a cement bypass arrangement. The cementing operations may comprise flowing the cement through the cement bypass arrangement from a region between the tool and the casing uphole of a sealing arrangement associated with the injection aperture and into the casing downhole of the sealing arrangement. The cement bypass arrangement may be the same as the bypass arrangement. I.e. the cementing operations may comprise flowing cement from the annulus into a region between the tool and the casing, and through an uphole bypass fluid port of the bypass arrangement so as to pass the cement into the casing from a downhole bypass fluid port. The cementing operations may comprise filling a region of the casing below the tool with cement, to create a cement plug. The method may comprise forming the cement plug on top of a conventional plug already placed in the well. The cementing operations may comprise filling the entire annulus adjacent the casing apertures with cement. The cementing operations may comprise filling the casing adjacent the first casing aperture and the second casing aperture from an uphole region to a downhole region.

The method may comprise flowing cement from the at least one injection aperture and into the annulus at the same time as the tool is moved relative to the casing.

The method may comprise moving the tool through the casing from an uphole location to a downhole location (i.e. top-down), or vice versa (i.e. bottom-up), while at the same time flowing the cement from the injection aperture and into the annulus and/or casing. As such, the cement may be flowed through or filled into an entire circumference of the annulus by movement of the tool through the casing. As the tool is moved through the casing, the apertures through which the cement flows may change. As the tool is moved through the casing, at least one of the plurality of casing apertures may function as a first casing aperture (i.e. to permit cement to flow from the injection aperture and into the casing), and at least one other of the plurality of casing apertures may function as a second casing aperture (i.e. to permit cement to flow from the annulus towards the inflow region). Depending on the flow of cement, an aperture that has functioned as a first aperture may also function as a second aperture, and vice versa. The cement may be flowed into the annulus, moving the tool in a top-down configuration.

The method may comprise flowing cement into the annulus at a rate proportionate to the velocity of movement of the tool through the casing. The method may comprise moving the tool in a continuous motion (e.g. a single continuous motion) through the casing while flowing cement into the annulus. Such movement of the tool through the casing may ensure that an even volume of the cement is flowed into or through the casing.

The method may comprise providing a pressure bypass arrangement on the tool to reduce the effect of a surge in well fluid pressure on the tool. For example, a high pressure fluid may pass through the pressure bypass arrangement on the tool, reducing the pressure acting on the surface of the tool and thereby the magnitude of force acting on the tool as a result of the high pressure. For example, a "kick" of fluid pressure (for example following the creation of a perforation in the casing and providing communication to a surrounding formation) may move in an uphole direction through the tool. This may reduce the movement of the tool as a result of the high pressure "kick", and thus reduce the safety risks of using the tool.

The pressure bypass arrangement may form an integral part of the tool.

The method may comprise configuring the pressure bypass arrangement to permit flow of a fluid therethrough when the tool is being run into the casing. For example, the pressure bypass arrangement may comprise a port that may be opened when the tool is being run into the casing to permit fluid flow therethrough. Permitting flow through the pressure bypass arrangement when the tool is being run in the casing may permit the tool to be run into the well with reduced fluid resistance, for example because fluid is more able to bypass the pressure bypass arrangement. As such, the pressure bypass arrangement may mitigate against the occurrence of a high differential pressure occurring across an uphole and a downhole section of the pressure bypass arrangement.

The pressure bypass arrangement may comprise a central bore through which a fluid may flow. The pressure bypass arrangement may comprise at least one pressure bypass port to allow fluid, e.g. a high pressure fluid, to flow out of the central bore and into the casing, for example. The pressure bypass arrangement may comprise an actuation mechanism to selectively open and close the pressure bypass port. The actuation mechanism may be in the form of a sleeve.

The actuation mechanism may be controlled or actuated by a fluid flowing in the central bore. For example, the force of a fluid flowing in the central bore may act upon the actuation mechanism to bias the actuation mechanism to open the at least one pressure bypass port. The actuation mechanism may be normally biased towards the closed position. The actuation mechanism may be normally biased towards the closed position by action of a biasing member, for example a spring.

An aspect of the present disclosure relates to a downhole apparatus for washing an annulus in a well, comprising: an external housing having a bore extending therethrough; a fluid injection port positioned on the housing; a pressure reduction apparatus positioned uphole of the fluid injection port; wherein a washing fluid is permissible to be passed through the fluid injection port and flowed towards the pressure reduction apparatus via the annulus to wash the annulus in the well.

In use, the downhole apparatus may be positioned in a well, and a washing fluid passed through the fluid injection port into an annulus to wash the annulus. The downhole apparatus comprises a pressure reduction apparatus to establish a pressure differential between the annulus and the downhole tool such that the washing fluid flows from the fluid injection port and towards the pressure reduction apparatus, thereby washing the annulus.

The pressure reduction tool may comprise at least one fluid aperture for passing a fluid therethrough. The fluid passing through the at least one fluid aperture may be an operating fluid. The operating fluid may be the same as the washing fluid. The at least one fluid aperture may be configured or positioned to direct an operating fluid being flowed therefrom in a specific direction. For example, the pressure reduction apparatus may comprise at least one fluid aperture configured to impart a circumferential and/or helical and/or vertical component of velocity to the operating fluid when passed therethrough. The at least one fluid aperture may comprise a nozzle, for example to augment the speed of a fluid passing therethrough, and/or to control the flow direction of a fluid passing therethrough.

The pressure reduction tool may comprise a vane or vanes extending helically relative to the axis of the tool. The vane or vanes may assist to control the direction of an operating fluid passing through the at least one fluid aperture in the pressure reduction tool. For example, the vane or vanes may assist to induce a swirling or helical motion of a fluid.

The at least one fluid aperture of the pressure reduction tool may be located on the helically extending vane or vanes. In this way, the positioning of the at least one fluid aperture, combined with the shape of the helically extending vane or vanes may assist to provide a swirling or helical motion of a fluid passing therethrough.

The downhole apparatus may comprise a seal or sealing arrangement. The sealing arrangement may comprise more than one seal. The downhole apparatus may comprise an upper seal (e.g. a cup seal) located uphole of the fluid injection port. The downhole apparatus may comprise a lower seal (e.g. a cup seal) located downhole of the fluid injection port. Where the upper seal and the lower seal are or comprise a cup seal, the upper seal and the lower seal may be oriented opposite one another.

The downhole apparatus may comprise a bypass arrangement having an uphole bypass port positioned uphole of the sealing arrangement and a downhole bypass port positioned downhole of the sealing arrangement. Such a bypass arrangement may allow a fluid to flow through and/or past the downhole apparatus, without the flow being restricted by the sealing arrangement. For example, when the tool is being moved downhole, resident fluid may provide resistance to motion as a result of the restrictions of the sealing arrangement. The bypass arrangement may reduce such resistance to motion of the tool. A user may be able to open and close the uphole and/or downhole bypass ports to provide variable operation of the bypass arrangement.

The downhole apparatus may comprise a releasable plug arrangement. The releasable plug arrangement may be able to be positioned in a casing, for example. The releasable plug arrangement may facilitate the performance of cementing operations, for example, such as by supporting a plug of cement from below.

The downhole apparatus may comprise a flow restrictor seating arrangement. The flow restrictor seating arrangement may be configured to catch a flow restrictor such as a dart, or other object, released from the surface of the well. The flow restrictor may enter the tool, and block or restrict fluid flow through the central bore of the external housing. While a flow restrictor is in place, fluid may flow from the tool only via the injection ports.

A flow restrictor such as a dart, or dropped object, may be dislodged from the flow restrictor seating arrangement by the user. The user may dislodge the flow restrictor by increasing the fluid pressure in the tool. Once the flow restrictor is dislodged, fluid flow may once again be established through the bore of the external housing. The bore of the external housing may extend along the entire axial length of the downhole apparatus e.g. along the entire axial length of the downhole apparatus in the configuration in which washing operations are performed.

The downhole apparatus may comprise a pressure bypass arrangement. The pressure bypass arrangement may facilitate running the tool into the casing by permitting the flow of a fluid past or through the tool when the tool is run downhole.

The pressure bypass arrangement may be located uphole of the pressure reduction tool and the seal or sealing arrangement.

An aspect of the present disclosure relates to a method for plugging a well which includes a wellbore casing and an annulus at least partially surrounding the wellbore casing, comprising: locating a tool inside the wellbore casing; flowing a washing fluid from an injection aperture on the tool into the annulus through a first casing aperture in the casing; creating an inflow region within the casing having reduced pressure relative to the annulus; flowing the washing fluid from the annulus and into the inflow region of the casing through a second casing aperture in the casing; and providing a plug in the well.

The method may comprise providing a plug in the annulus. The method may comprise providing a plug within the casing.

The method may comprise providing a cement plug. The cement plug may be provided above a support plug. The method may comprise setting the support plug. The support plug may be, for example, a plug made from synthetic plastics or rubber material. The support plug may support the cement plug. The support plug may permit the cement plug to be formed thereon.

The cement plug may be provided by flowing cement via a cement bypass arrangement to, for example, bypass a sealing arrangement on the tool. The cement bypass arrangement may extend through the tool. The cement plug may be provided by flowing cement via the injection aperture to an uphole region of the bypass arrangement, and exiting from a downhole region of the cement bypass arrangement. The cement may be flowed from the injection aperture and through the first casing aperture into the annulus, and flowed from the annulus back through the second casing apertures and into the uphole region of the bypass arrangement. As such, the cement bypass arrangement may permit cement to be disposed in a location downhole of the tool.

The features of any previously described example may be used in combination with any other described example.

BRIEF DESCRIPTION

DETAILED DESCRIPTION

Figure 1:
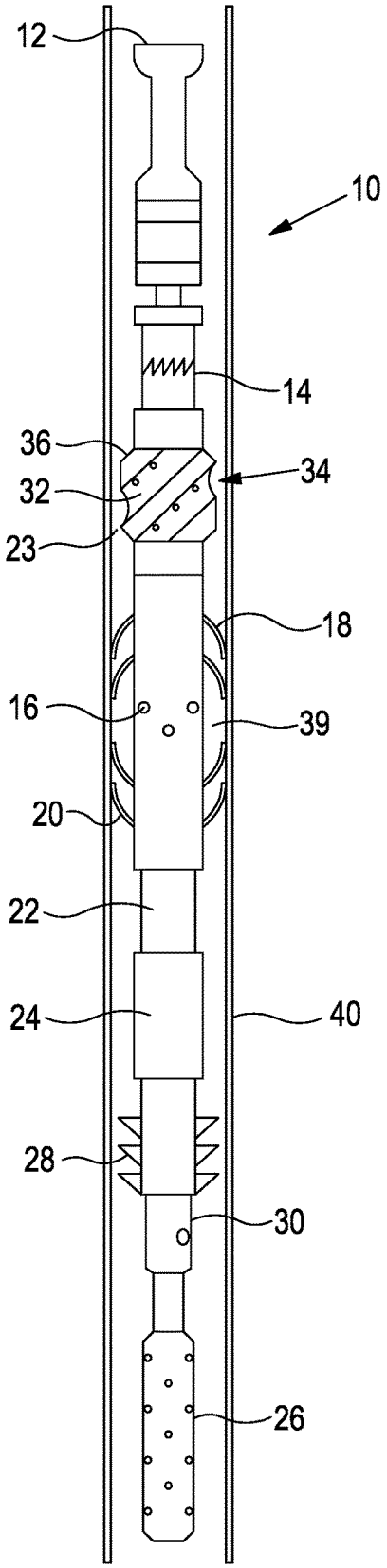
FIG. 1 is a schematic illustration of a tool used for washing a well.

FIG. 1 is a schematic illustration of a tool 10 used for washing an annulus region in a well. The tool 10 is attached to a tool string 12 via disconnect 14, and the tool string 12 is itself attached to a work string (not shown). The work string may be, for example, jointed pipe and/or coiled tubing, and may be used to convey the tool 10 into the well, and conduct fluid, e.g. a washing fluid, between the surface and the tool 10.

The tool 10 comprises injection apertures 16 through which a fluid can be flowed, with cup seals 18, 20 provided on either axial side of the injection apertures 16. The cup seals 18, 20 provide a seal between the tool and the casing 40 and define an injection region 39 therebetween.

The tool 10 further includes a pressure reduction apparatus 34 positioned uphole of the cup seals 18, 20 and the injection apertures 16, wherein the pressure reduction apparatus 34 comprises a plurality of fluid apertures 32 and vanes 36. The apertures 32 may be placed, and shaped, so as to confer a substantial circumferential component of velocity to an operating fluid flowing therethrough. For example, the apertures 32 may include nozzles, designed to increase the velocity to the operating fluid, and/or eject the operating fluid from the pressure reduction apparatus 34 in a helical direction.

Similarly, the vanes 36 are configured to encourage flow in a radial direction of the fluid flowing from the apertures 32. As such, fluid passing from the pressure reduction apparatus 34 tends to swirl around the apparatus 34, thereby increasing the speed of fluid flow in this region and establishing a localized reduction in pressure. As will be described in more detail below, this area of reduced pressure encourages flow from an annulus region surrounding the casing 40, and as such the area adjacent the pressure reduction apparatus 34 within the casing 40 may be defined as an inflow region 23.

In the present example the tool 10 further includes a perforation system 26 at the leading end of the tool 10 for use in establishing perforations in the casing 40. The perforation system 26 may comprise, for example, TCP guns, fluid jet perforating devices, chemical cutting devices, tubing punches, or the like. It should be noted that, although a perforation system 26 is shown in this example, in other examples a perforation system may not be necessary. Instead, the tool 10 may be run into a section of casing having pre-existing perforations, for example.

The tool 10 further includes a burst disk sub 30, dart sub 22 and dart catcher 24. A dart (not shown) may be used to seat in the dart sub 22, thereby blocking flow through the dart sub 22. When flow through the dart sub 22 is blocked, fluid may only pass from the tool through the injection apertures 16 or the apertures 32 of the pressure reduction apparatus 34.

The tool 10 includes a plug 28 axially downhole of the dart sub 22 and dart catcher 24. Although not shown, the plug 28 is attached to the tool 10 via a pressure release mechanism, such that the plug 28 may be released upon pressurization of the fluid in the tool 10. The skilled person will understand that there are several known release mechanisms that would be suitable for this purpose.

Figure 2:
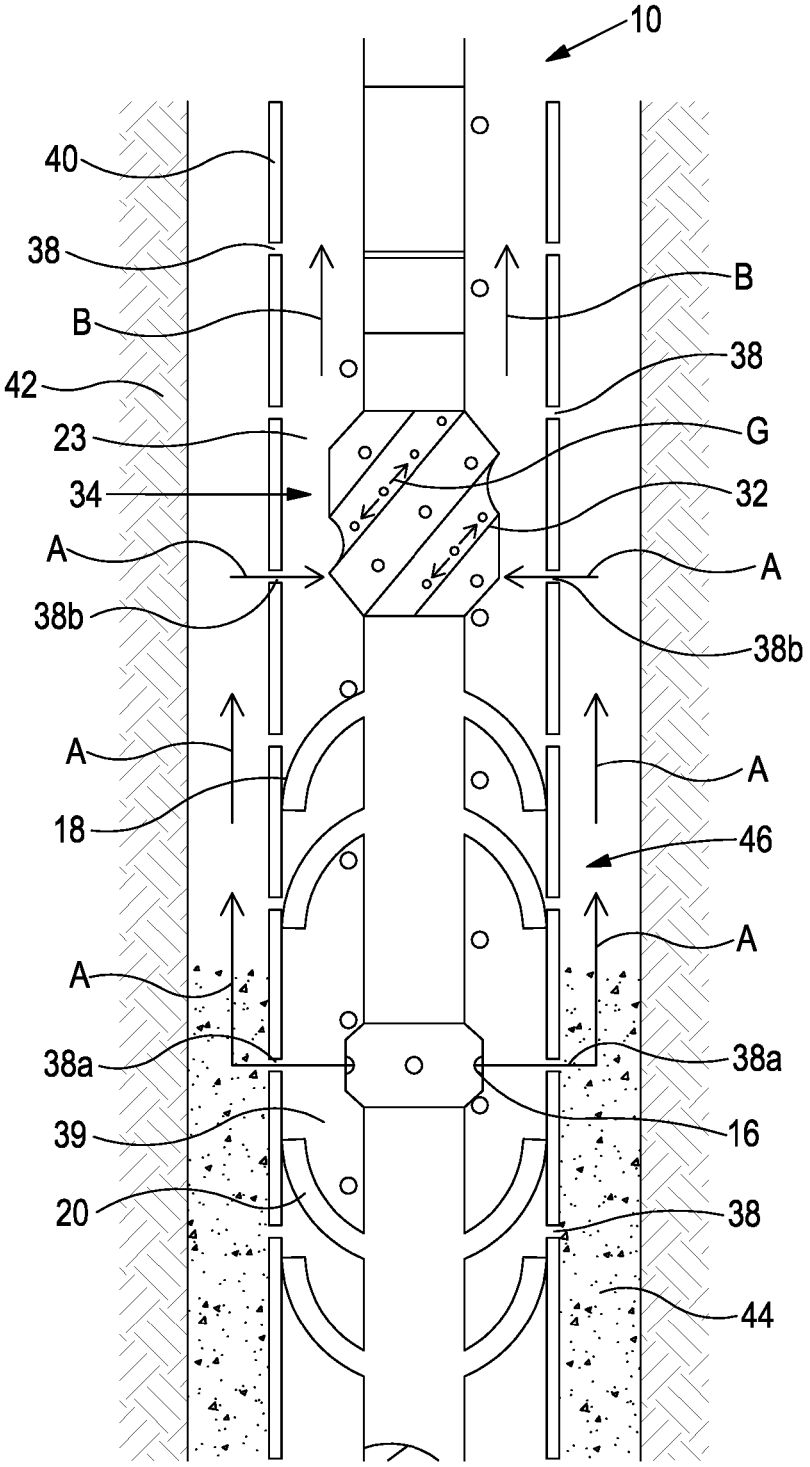
FIG. 2 is a schematic illustration of injection apertures and a pressure reduction apparatus of the tool.

FIG. 2 shows a section of the tool 10 in greater detail, including the casing 40 in which the tool 10 has been placed, and a surrounding formation 42. An annulus 46 is defined between the casing 40 and formation 42, and in the present example the annulus is filled with cement 44 which is to be at least partially removed by action of the tool. In alternative examples the annulus 46 may be filled with debris, for example from the original well drilling operation. Perforations 38 in the casing 40, created by the perforation system 26 (FIG. 1), establish fluid communication between the casing 40 and annulus 46. In this respect the presence of the seals 18, 20 provide or create a communication path between the injection region 39 and the inflow region 23 via the annulus 46.

In use, washing fluid is pumped from surface and exits the tool 10 via the injection apertures 16 and into the injection region 39, and then into the annulus 46 via one or more of the casing perforations 38, illustrated by arrows A. In this respect, a perforation 38 which provides such communication of fluid into the annulus 46 may be defined as a first casing aperture 38*a*. A plurality of first casing apertures 38*a* may accommodate flow into the annulus 46.

The washing fluid then moves upwardly through the annulus 46 and disrupts or breaks-up the cement 44, with the washing fluid and cement debris flowing back into the casing 40, specifically into the inflow region 23, via different casing perforations 38. In this respect, a perforation 38 which provides such communication of fluid from the annulus 46 may be defined as a second casing aperture 38*b*. A plurality of second casing apertures 38*b* may accommodate flow from the annulus 46. The washing fluid and entrained cement debris may then flow to surface in the direction of arrows B.

A portion of the washing fluid also flows from the apertures 32 of the pressure reduction apparatus 34 (indicated by arrows G) and into the inflow region 23. The swirling motion of the fluid caused by the pressure reduction apparatus 34 creates a localized region of relatively lower pressure, at least relative to the pressure within the annulus 46. This lower pressure within the inflow region 23 assists to draw or encourage the washing fluid and cement debris into the casing 40 from the annulus 46. This can assist in providing a better cleaning or washing within the annulus 46.

The tool 10 can be moved uphole and downhole relative to the casing 40 to wash an extended length of the annulus 46. As the tool 10 is moved uphole and downhole in the casing 40, the inflow region 23 and injection region 39 move with the tool 10. In this regard, a perforation 38 which at one stage functioned as a first casing aperture 38*a* (i.e., to allow flow into the annulus 46), may later function as second casing aperture 38*b* (i.e., to allow flow from the annulus 46).

Using some prior washing techniques, there is a tendency for the washing fluid to spread out in the annulus, which can reduce the efficacy of the wash. However, the present invention negates such drawbacks, for example through use of pressure reduction apparatus to encourage flow of washing fluid and debris into casing 40.

Figure 3A:
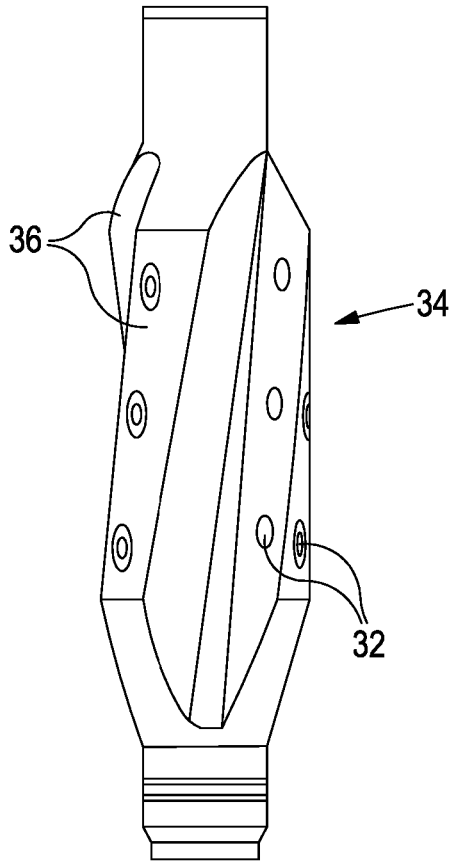
FIG. 3A is a further schematic illustration of the pressure reduction apparatus.
Figure 3B:
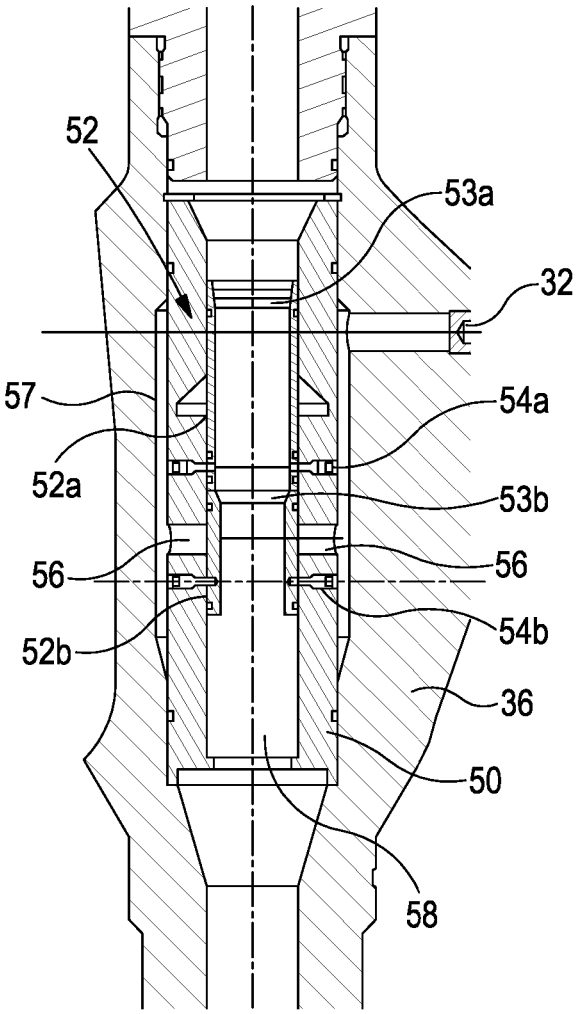
FIG. 3B is a sectional view of the pressure reduction apparatus.

FIGS. 3A and 3B illustrate an example of the pressure reduction apparatus 34. The pressure reduction apparatus 34 comprises the apertures 32 and vanes 36, which as noted above encourage a swirling or turbulent flow region within the inflow region 23 (FIGS. 1 and 2). Apertures 32 are located on the outer circumferential surface of the vanes 36 (i.e. the tips of the vanes), as well as in the recessed sections between the vanes 36.

FIG. 3B illustrates a sectional view of the pressure reduction apparatus 34. The pressure reduction apparatus 34 comprises a flow distribution sleeve 50 which includes a plurality of radial ports 56, wherein the flow distribution sleeve 50 is mounted within the apparatus 34 to define a distribution annulus 57 which communicates with all of the apertures 32. When the radial ports 56 are opened, fluid may thus flow from the apparatus 34.

The pressure reduction apparatus 34 further includes an internal sleeve system 52 which functions to selectively close and open the radial ports 56 in the flow distribution sleeve 50, thus to selectively permit flow from the pressure reduction apparatus 34. The sleeve system 52 includes an upper sleeve 52*a* and a lower sleeve 52*b*, with the upper and lower sleeves 52*a*, 52*b* initially fastened to the flow distribution sleeve 50 via respective shear pins 54*a*, 54*b*. While the present example uses shear pins, multiple alternative options are possible, and in some cases resettable options may be used. When in the initial illustrated configuration, the lower sleeve 52*b* closes the radial ports 56 in the flow distribution sleeve 50. Each sleeve 52*a*, 52*b* includes a respective seat 53*a*, 53*b* for receiving an object, such as a ball or dart, dropped from surface. In the present example the seat 53*b* of the lower sleeve 52*b* defines a smaller diameter than the seat 53*a* of the upper sleeve 52*a* to facilitate sequential operation using appropriately sized objects.

When it is desired to open the radial ports 50, and thus permit flow from the pressure reduction apparatus 34, an object (not shown) is dropped to engage the seat 53*b* of the lower sleeve 52*b*. The impact force, and/or pressure developed behind the object shears pins 54*b* with the lower sleeve 52*b* then moved to open the ports 56 and permit a fluid (e.g. a washing fluid) to flow from a main bore 58 of the pressure reduction apparatus 34 and ultimately through the fluid apertures 32. The object responsible for shifting the lower sleeve 52*b* may be removed, for example by being degradable, pushed past its seat 53*b* or the like, thus maintaining the main bore 58 open.

When the ports 56 are to be closed, an object (not shown) of a larger diameter is dropped to engage the seat 53*a* of the upper sleeve 52*a*. The impact force, and/or pressure developed behind the object shears pins 54*a* with the upper sleeve 52*a* then moved to occlude the ports 56.

Figure 4B:
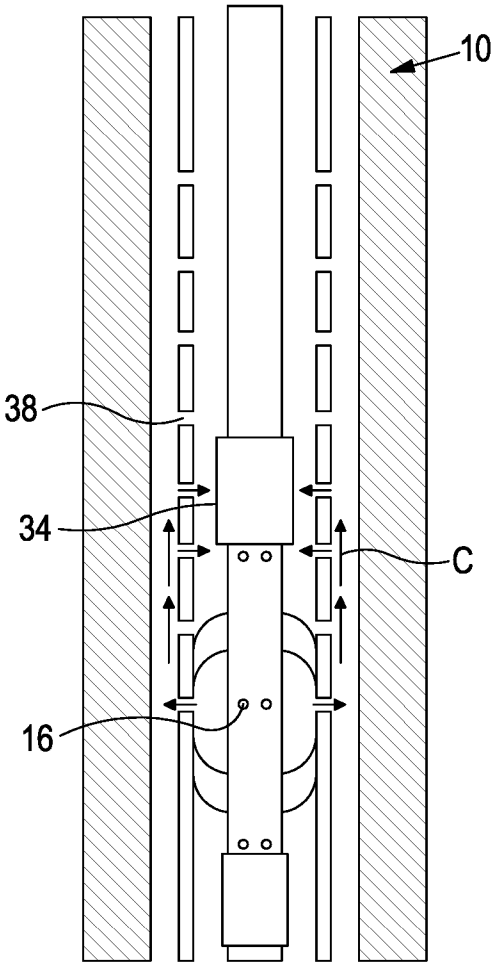
FIGS. 4A and 4B are simplified illustrations of a method of use of the tool.
Figure 4A:
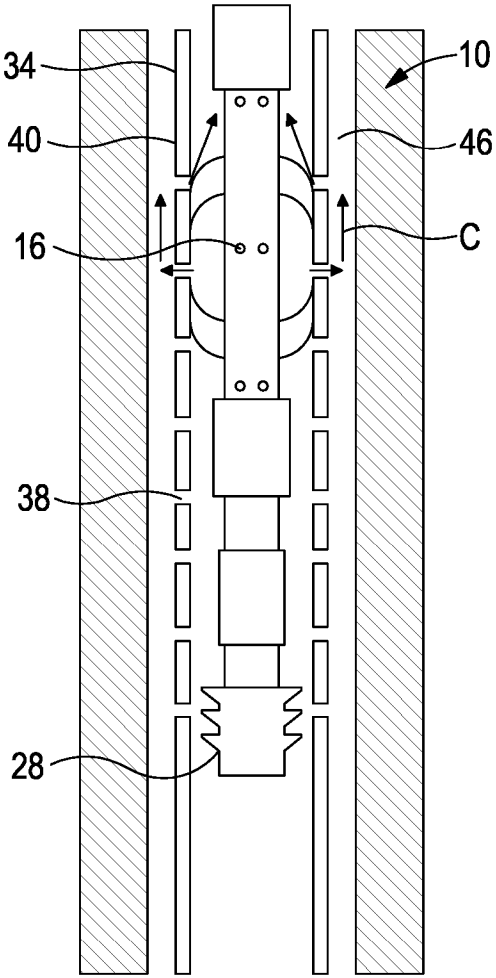

FIGS. 4A and 4B illustrate the tool 10 in use for washing a casing 40. The tool 10 is held adjacent the perforations 38 closest to the surface. Washing fluid is flowed through the injection apertures 16 and passes through the perforations 38 in the casing 40. The washing fluid flows in the direction of arrows C, through the annulus 46 and back inside the casing 40. The pressure reduction apparatus 34 encourages the washing fluid to re-enter the casing via perforations 38 adjacent, or nearest to, the pressure reduction apparatus 34.

Washing fluid is continually flowed through the injection apertures 16 as the tool 10 is moved downhole, as shown in FIG. 4B. The rate of movement downhole of the tool 10 is proportional to the rate at which washing fluid is flowed through the injection apertures 16. The tool may be moved in an incremental step-wise motion. Alternatively, the tool may be moved in a continuous motion through the casing. As the tool is moved, washing fluid is flowed through perforations 38 further downhole, thereby washing the section of the casing 40 located further downhole.

As shown by the arrows C of FIG. 4B, as the pressure reduction apparatus 34 is moved downhole with the tool 10, the washing fluid re-enters the casing through perforations 38 adjacent the pressure reduction apparatus 38. Using the tool 10 in this way, the entire section of casing 40 in the region of the perforations 38 may be washed.

The operation described in FIGS. 4A and 4B may be performed multiple times to improve the quality of the washing of the casing. Further, the operation may be performed multiple times, using more than one type of washing fluid.

The plug 28 of the tool 10 is illustrated in FIG. 4A. Once the tool 10 has been moved to the position shown in FIG. 4B, the plug 28 may be installed or set in the casing 40, to act as a support for future operations, for example future cementing operations. The plug 28 may be set in the casing 40 once the tool 10 has reached the position show in FIG. 4B, or alternatively, the tool 10 may be moved further downhole before the plug 28 is set.

As the plug 28, as well as some other parts of the tool 10, defines a relatively large diameter, there may be a problem whereby sudden influxes or kicks in pressure into the casing 40 are unable to quickly bypass the plug 28, and have the effect of forcing the tool 10 in the uphole direction. This can cause the work string to rapidly spool from the well, which can be dangerous. A bypass arrangement, such as that described later with reference to FIGS. 7A to 7C may be used to mitigate against such issues.

Figure 5B:
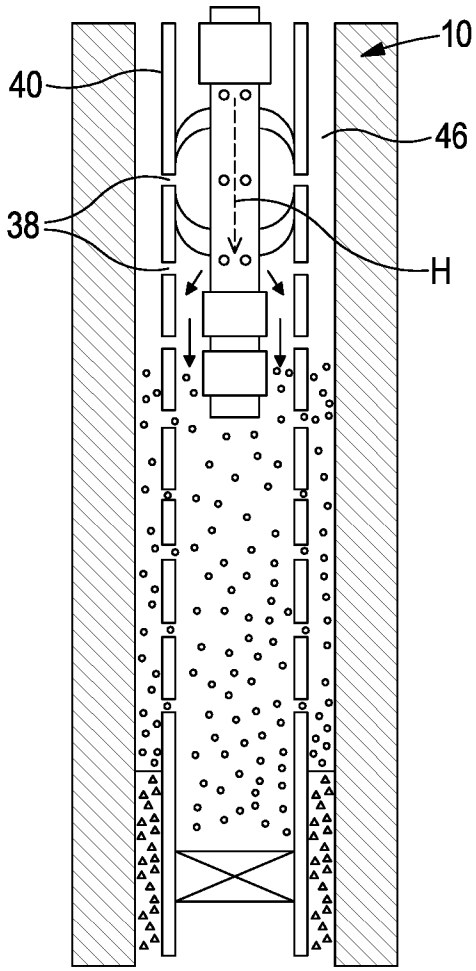
FIGS. 5A and 5B are simplified illustrations of a further method of use of the tool.
Figure 5A:
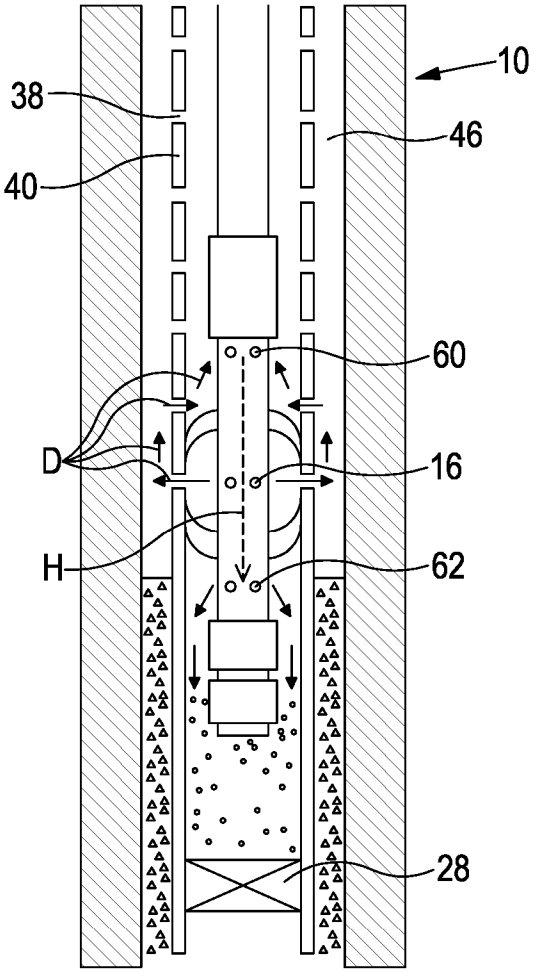

FIGS. 5A and 5B illustrate a use of the tool 10 to flow a fluid such as cement into the casing. Such flow of cement may be performed immediately following a washing operation as described above. In the present example the tool 10 is placed with the injection apertures 16 adjacent the furthest downhole of the perforations 38 in the casing 40. As shown, plug 28 is placed in the casing to support a cement plug formed on top thereof. Cement is then flowed through the tool 10, through the injection ports 16, and through the perforations 38 in the casing 40 in the direction of arrows D. As the cement fills the annulus, and moves in the uphole direction through the annulus, the cement will re-enter the casing 40 and flow through upper bypass ports 60. Upper bypass ports 60 then direct the cement through a fluid bypass (not visible) and out through lower bypass ports 62. The cement is then able to fill the casing below the tool 10 and on top of the previously set plug.

Once the cement has begun to fill the casing 40 downhole of the fluid injection apertures 16, the tool 10 can be moved uphole, while continually flowing cement though the tool 10. In this way, the tool 10 can be used to place cement in the annulus 46 and the casing 40. The rate of movement of the tool 10 in the uphole direction is proportionate to the rate at which the cement is flowed through the tool 10 so as to allow an even distribution of cement in the casing 40 and annulus 46. The tool 10 can be moved in a continuous motion through the casing 40, or in an incremental step-wise motion.

The flowing of cement into the casing 40 may be performed after the casing has been washed. The washing of the casing may permit a better bond to be achieved between the casing and the cement.

Figure 6:
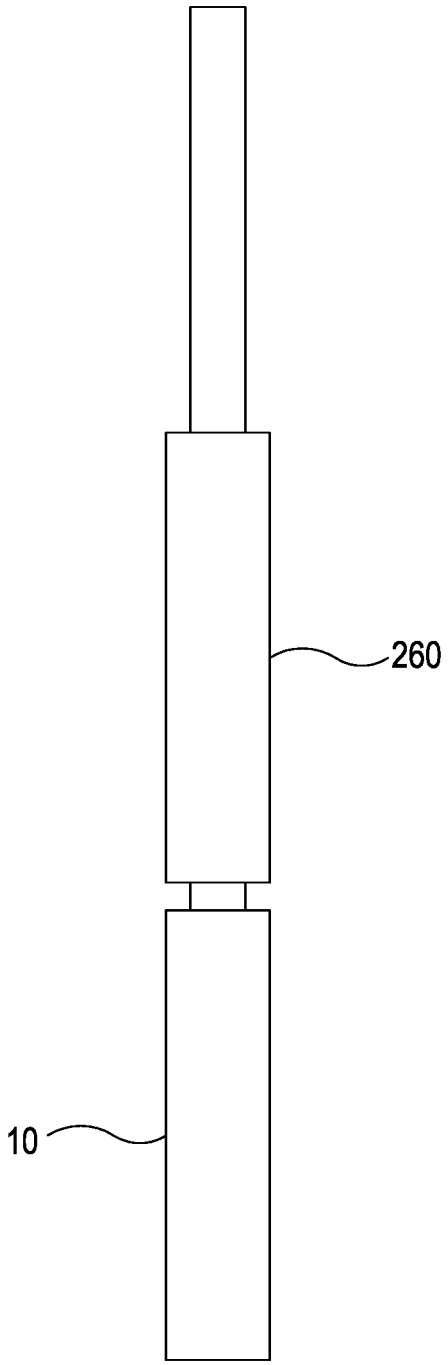
FIG. 6 is a schematic illustration of a tool comprising a pressure bypass arrangement.

FIG. 6 schematically illustrates the tool 10 as described above with the addition of a pressure bypass arrangement 260. The pressure bypass arrangement 260 is located above the tool. In some examples the pressure bypass arrangement 260 may be provided separately from the tool 10, or as an integrated feature.

Figure 7C:
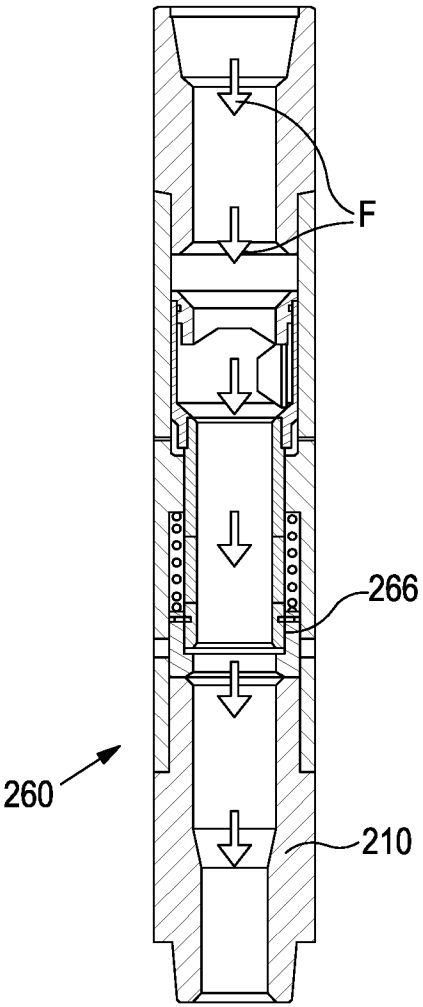
FIGS. 7A to 7C are sectional illustrations of the pressure bypass arrangement.
Figure 7B:
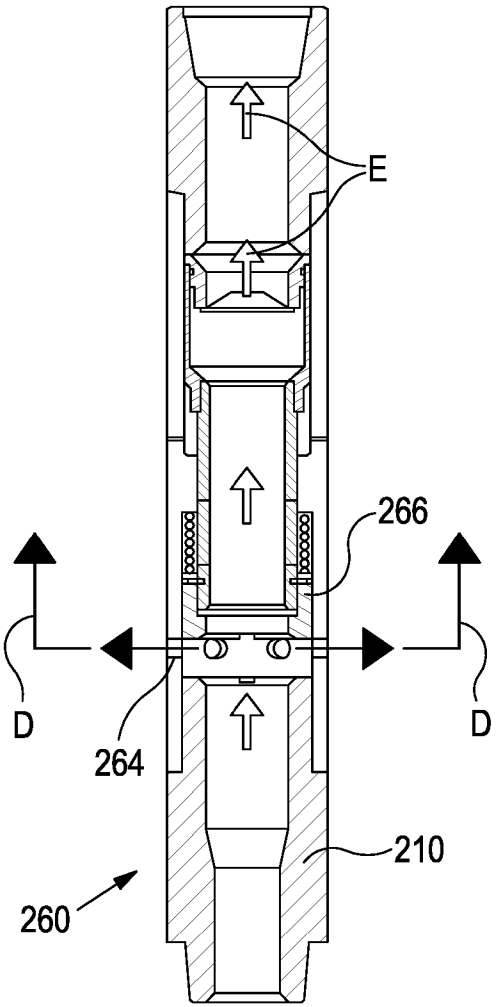
Figure 7A:
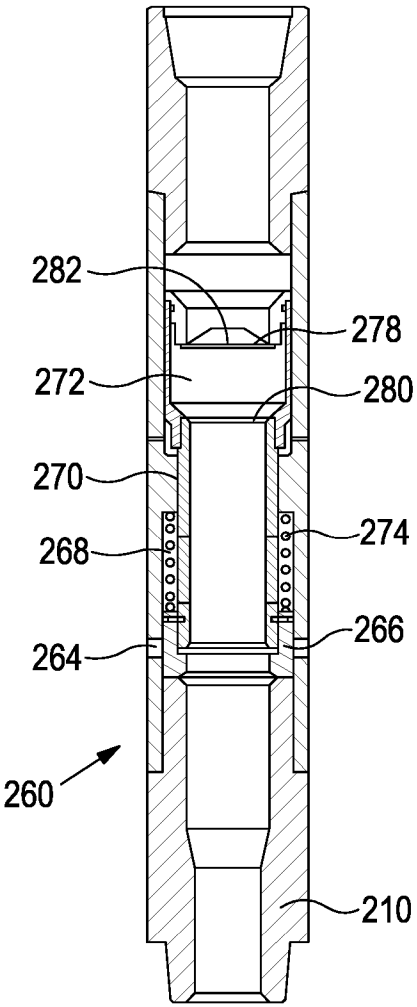

FIGS. 7A to 7C illustrate the internal detail of the pressure bypass arrangement 260. In this example, the pressure bypass arrangement 260 forms a part of the tool 10, and comprises an array of pressure bypass ports 264.

FIG. 7A illustrates the pressure bypass arrangement 260 in a normally closed configuration, meaning that a sleeve assembly 266 of the pressure bypass arrangement 260 is occluding the array of pressure bypass ports 264. The sleeve assembly 266 is partially housed in an annulus 268 formed between a shear sleeve 270 and an outer housing 272 of the pressure bypass arrangement, and partially housing in a central bore 280 of the pressure bypass arrangement 260. Spring 274 biases the sleeve 266 towards the closed position.

The shear sleeve 270 is attached to a flapper valve assembly comprising a flapper valve 278 which can be opened to allow fluid through the central bore 280 of the pressure bypass arrangement 260 and closed to substantially block flow therethrough. The flapper valve 278 comprises a flapper aperture 282, in this example located in the center thereof, to allow a reduced fluid flow therethrough.

FIG. 7B illustrates the pressure bypass arrangement 260 in a run-in configuration. In this configuration, fluid flowing in the uphole direction as a result of the tool 210 being run downhole, impinges on the sleeve assembly 266 and flapper valve 278, and creates a build-up of pressure beneath the flapper valve 278. Once the pressure beneath the flapper valve builds to a threshold level, the sleeve assembly 266 moves in an uphole direction, compressing the spring 274. This has the effect of removing the occlusion to the pressure bypass ports 264 caused by the sleeve assembly 266 to allow fluid communication between the central bore 280 and the casing (not shown). A fluid in the central bore 280 is then permitted to flow from the central bore and into the casing in the direction of arrows D. As a result of the flapper aperture 282, some fluid is also permitted to continue to flow through the central bore 280 of the pressure bypass arrangement, in the direction of arrows E. In opening the pressure bypass ports 264 the tool 210 may be run downhole more quickly.

FIG. 7C illustrates the pressure bypass arrangement 260 in a circulating configuration. In this configuration, the tool 210 may be used to circulate a fluid in a well (not shown). As such, fluid is flowing in the downhole direction, as illustrated by arrows F, through the central bore 280 of the pressure bypass arrangement, and flapper valve 278 is opened. The downhole flow of fluid causes spring 274 to bias the sleeve assembly 266 towards the downhole direction, thereby closing the array of pressure bypass ports 264.

The pressure bypass arrangement 260 may improve the safety of operation of the tool 10 by allowing the tool to react more preferably to sudden influxes, or kicks, of pressurized fluid in a well. For example, a sudden influx of pressure into the pressure bypass arrangement may create a brief flow of fluid in the uphole direction through the pressure bypass arrangement. Such an up-flow of fluid may act on the sleeve assembly 266 in an uphole direction to open pressure bypass ports 264, thus allowing the pressurized fluid to escape from the tool 210 and into the casing (not shown). In doing so, an operator may be able to avoid an influx of pressure physically moving the tool 10, and the entire associated tool string, back uphole, as sudden uphole movement of the tool string may cause safety concerns at the surface of the well.

The invention claimed is:

1. A method for washing an annulus that at least partially surrounds a casing in a well, the method comprising:

locating a tool inside the casing;

flowing a washing fluid from an injection aperture on the tool into the annulus through a first casing aperture in the casing;

creating an inflow region within the casing having reduced pressure relative to the annulus using a pressure reduction apparatus, wherein the pressure reduction apparatus comprises at least one fluid aperture disposed on at least one helically extending vane, configured to impart a helical component of velocity to an operating fluid when passed through the pressure reduction apparatus; and flowing the washing fluid from the annulus and into the inflow region of the casing through a second casing aperture in the casing.

2. The method according to claim 1, wherein the at least one fluid aperture establishes a swirl of the operating fluid at the inflow region, thereby establishing reduced pressure within the inflow region relative to the annulus.

3. The method according to claim 2, wherein the washing fluid and the operating fluid are the same fluid.

4. The method according to claim 2, comprising directing the operating fluid using the at least one helically extending vane on the tool.

5. The method according to claim 1, comprising providing a sealing arrangement between the tool and the casing to restrict flow of the washing fluid in the casing, wherein the sealing arrangement is positioned adjacent the injection aperture on the tool.

6. The method according to claim 1, comprising flowing the washing fluid from the injection aperture and into the annulus at the same time as the tool is moved relative to the casing.

7. The method according to claim 1, comprising:

ceasing flow of the washing fluid from the injection aperture;

moving the tool to a different location in the casing; and reinstating flow of the washing fluid through the injection aperture.

8. The method according to claim 1, comprising setting a plug downhole of the tool.

9. The method according to claim 1, comprising flowing cement through a cement bypass arrangement on the tool; and filling a region of the casing below the tool with cement to create a cement plug.

10. The method according to claim 1, comprising relieving pressure via a pressure bypass arrangement on the tool to reduce the effect of a surge in well fluid pressure acting on the tool.

11. A downhole apparatus for washing an annulus that at least partially surrounds a casing in a well, comprising:

an external housing having a bore extending therethrough;

a fluid injection port positioned on the housing; and a pressure reduction apparatus positioned uphole of the fluid injection port;

wherein, in use, a washing fluid is passed through the fluid injection port and flowed towards the pressure reduction apparatus via the annulus to wash the annulus in the well; and wherein the pressure reduction apparatus comprises at least one fluid aperture disposed on at least one helically extending vane, configured to impart a helical component of velocity to an operating fluid when passed through the pressure reduction apparatus.

12. The downhole apparatus according to claim 11, wherein the at least one helically extending vane of the pressure reduction apparatus extends helically relative to the axis of the tool.

13. The downhole apparatus according to claim 11, comprising at least one of an upper seal located uphole of the fluid injection port, and a lower seal located downhole of the fluid injection port.

14. The downhole apparatus according to claim 13, comprising a bypass arrangement having an uphole bypass port positioned uphole of the upper seal and a downhole bypass port positioned downhole of the lower seal.

15. The downhole apparatus according to claim 11, comprising a releasable plug arrangement configured to be released form the downhole apparatus and set in the casing within which the apparatus is located.

16. The downhole apparatus according to claim 11, comprising a pressure bypass arrangement.

17. The method according to claim 1, comprising flowing cement from the tool and into the annulus.

18. A method for plugging a well which includes a wellbore casing and an annulus at least partially surrounding the wellbore casing, comprising:

locating a tool inside the wellbore casing;

flowing a washing fluid from an injection aperture on the tool into the annulus through a first casing aperture in the wellbore casing;

creating an inflow region within the wellbore casing having reduced pressure relative to the annulus using a pressure reduction apparatus, wherein the pressure reduction apparatus comprises at least one fluid aperture disposed on at least one helically extending vane, configured to impart a helical component of velocity to an operating fluid when passed through the pressure reduction apparatus;

flowing the washing fluid from the annulus and into the inflow region of the casing through a second casing aperture in the wellbore casing; and providing a plug in the well.

19. The method according to claim 18, comprising providing a plug in the annulus and within the wellbore casing.

* * * * *